US009079399B2

(12) United States Patent
Weijkamp et al.

(10) Patent No.: US 9,079,399 B2
(45) Date of Patent: Jul. 14, 2015

(54) METHOD FOR OPERATING A PRINTING SYSTEM

(71) Applicant: Océ-Technologies B.V., Venlo (NL)

(72) Inventors: Clemens T. Weijkamp, Lomm (NL); Johannes A. T. Gollatz, Roermond (NL); Herbert Morelissen, Tegelen (NL)

(73) Assignee: OCÉ-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 14/279,068

(22) Filed: May 15, 2014

(65) Prior Publication Data

US 2014/0340449 A1 Nov. 20, 2014

(30) Foreign Application Priority Data

May 16, 2013 (EP) ..... 13167975

(51) Int. Cl.
*B41J 2/165* (2006.01)
*B41J 2/14* (2006.01)
*B41J 2/175* (2006.01)

(52) U.S. Cl.
CPC ... *B41J 2/14* (2013.01); *B41J 2/175* (2013.01)

(58) Field of Classification Search
None
See application file for complete search history.

(56) References Cited

U.S. PATENT DOCUMENTS

| | | | | |
|---|---|---|---|---|
| 6,224,201 | B1 | 5/2001 | Shigemura | |
| 2003/0160846 | A1 | 8/2003 | Yoshida et al. | |
| 2004/0135829 | A1 | 7/2004 | Yoshida | |
| 2005/0146569 | A1 | 7/2005 | Hoisington et al. | |
| 2007/0165053 | A1 | 7/2007 | Oguri | |
| 2007/0252860 | A1 | 11/2007 | Nitta et al. | |
| 2008/0218554 | A1* | 9/2008 | Inoue | 347/33 |
| 2009/0009544 | A1 | 1/2009 | Kumagai et al. | |
| 2009/0213197 | A1* | 8/2009 | Bansyo | 347/89 |
| 2011/0050794 | A1 | 3/2011 | Koike et al. | |
| 2012/0140006 | A1 | 6/2012 | Yunoki et al. | |
| 2012/0188314 | A1 | 7/2012 | Akiyama et al. | |
| 2012/0194620 | A1 | 8/2012 | Matsumoto et al. | |

* cited by examiner

*Primary Examiner* — Alejandro Valencia
(74) *Attorney, Agent, or Firm* — Birch, Stewart, Kolasch & Birch, LLP

(57) ABSTRACT

A printing system for printing a fluid includes a print head for ejecting droplets of the fluid; a first fluid storing section for storing a first amount of the fluid; a second fluid storing section for storing a second amount of the fluid, the second fluid storing section being in fluid communication to the pressure chamber in a power down situation; and a pre-tension device configured for arranging the second amount of the fluid in a pre-tension state in the second fluid storing section, thereby providing a positive fluid pressure on the nozzle in a power down situation, which positive fluid pressure is selected such that a third amount of fluid passes through the nozzle in response to said positive fluid pressure and forms a film on the nozzle plate. The printing system according to the invention supports the recovery of the print head after a power down situation.

18 Claims, 7 Drawing Sheets

METHOD FOR OPERATING A PRINTING SYSTEM

FIELD OF THE INVENTION

The present invention relates to a printing system. The present invention further relates to a method for operating the printing system.

BACKGROUND OF THE INVENTION

A known printing system comprises a print head and a fluid storing buffer. The print head is configured for ejecting droplets of a fluid in printing operation. The print head comprises a pressure chamber for containing the fluid and a nozzle plate which comprises a nozzle. The pressure chamber is in fluid connection to the nozzle. The fluid storing buffer is in fluid connection to the pressure chamber and contains an amount of the fluid, which is supplied to the pressure chamber in printing operation of the print head. The fluid storing buffer is arranged lower than the nozzle of the print head in order that the fluid in the fluid storing buffer provides a negative fluid pressure to the fluid in the pressure chamber. In this way it is prevented that during printing operation the fluid flows out of the nozzle and covers the nozzle plate, which would hinder the formation of a droplet during ejection of the fluid. Furthermore the negative fluid pressure to the fluid in the pressure chamber prevents that in a power down situation the fluid in the print head will drip from the print head and contaminates the printing system. During a standby situation of the printing system the print head may be positioned in a capping station thereby enclosing and conditioning the nozzle plate in order to prevent drying of the fluid in the nozzle. A disadvantage of the printing system is that in an unexpected power down situation of the printing system, the print head may not be positioned in the capping station and the fluid in the nozzle may dry out. As a result it may be hard to recover the print head. Moreover additional print head maintenance means may be needed, such as e.g. a wet wiper of the nozzle plate and a flushing of the print head.

SUMMARY OF THE INVENTION

It is accordingly an object of the present invention to provide a printing system for printing a fluid, the printing system comprising a print head, wherein the printing system may support the recovery of the print head after a power down situation.

This object is attained by a printing system for printing a fluid, the printing system comprising:

- a print head for ejecting droplets of the fluid, the print head comprising a pressure chamber, which pressure chamber in printing operation contains the fluid, and a nozzle plate which comprises a nozzle, the pressure chamber being in fluid communication to the nozzle, the nozzle containing a meniscus of the fluid;
- a first fluid storing section, in printing operation containing a first amount of the fluid, the first fluid storing section being in fluid communication to the fluid in the pressure chamber, the first amount of the fluid being arranged lower with respect to the nozzle, wherein lower is defined with respect to the gravity force acting downwards in a direction (g) towards a ground level, thereby providing a negative fluid pressure on the meniscus of the fluid in the nozzle;
- a second fluid storing section configured for storing a second amount of the fluid, the second fluid storing section in a power down situation being arranged in fluid communication to the pressure chamber; and
- a pre-tension means being configured for in printing operation arranging the second amount of the fluid in a pre-tension state in the second fluid storing section, wherein said pre-tension state of the second amount of fluid provides a positive fluid pressure $P_u$ on the meniscus of the fluid in the nozzle in response to the power down situation, and wherein the positive fluid pressure $P_u$ is selected such that a third amount of the fluid passes through the nozzle in response to said positive fluid pressure $P_u$ and forms a film on the nozzle plate;
- wherein the pre-tension means further is configured for retaining in printing operation the second amount of the fluid inside the second fluid storing section, thereby in printing operation restraining the positive fluid pressure $P_u$ from acting on the meniscus of the fluid in the nozzle.

The result of the printing system according to the invention is that in response to a power down situation a film is formed on the nozzle plate by the third amount of fluid. Said film of fluid is formed on a portion of the nozzle plate, which film prevents or at least retards a drying of the fluid in the nozzle. As a result a recovery of the print head after the power down situation is easy to perform and the durability of the print head is preserved. The fluid in the film may be supplied by a portion of the second amount of the fluid or by the second amount of the fluid as a whole.

The first fluid storing section is configured for storing a first amount of the fluid, which first amount of the fluid is arranged lower than the nozzle in order to provide a negative fluid pressure in the nozzle. The first amount of the fluid is suitably selected sufficient for replenishing the pressure chamber during printing operation of the print head. In particular the upper level of the first amount of the fluid is arranged lower than the nozzle, thereby providing a hydrostatic negative fluid pressure on the meniscus of the fluid in the nozzle both in a printing operation and in a power down situation. As used herein lower is defined with respect to the gravity force acting downwards in a direction (g) towards a ground level. As a result in a power down situation the first amount of the fluid stays in the first fluid storing section and will not lead to contamination of the printing system. In an embodiment the first fluid storing section includes an upper end which is arranged lower than the nozzle.

The second fluid storing section is in a power down situation in fluid communication to the pressure chamber of the print head. The second fluid storing section may be in printing operation in fluid communication to the pressure chamber of the print head. Alternatively in printing operation said fluid connection to the pressure chamber of the print head may be blocked by a fail to open fluid valve, which fail to open fluid valve opens in response to a power down situation.

As used herein the second fluid storing section being in fluid communication is that any fluid pressure present in the second amount of the fluid in the second fluid storing section is communicated to the pressure chamber. Preferably the second fluid storing section is additionally in fluid communication to the first fluid storing section. In a particular embodiment the second fluid storing section may be arranged in fluid communication in between the first fluid storing section and the pressure chamber. Alternatively the first fluid storing section may be arranged in fluid communication in between the second fluid storing section and the pressure chamber.

The pre-tension means arranges the second amount of the fluid in the second fluid storing section in the pre-tension state. As a result of the second amount of the fluid a fluid pressure $P_u$ is induced on the meniscus of the fluid in the nozzle. The pre-tension means is further configured for retaining in printing operation the second amount of the fluid in the second fluid storing section. Thereby the fluid pressure $P_u$ is restrained by the pre-tension means from acting on the nozzle during printing operation. The pre-tension means may in an embodiment retain the second amount of the fluid in the second fluid storing section by providing a balancing counterforce to the second amount of the fluid, which balancing counterforce is directed as counterforce to the fluid pressure $P_u$. For example a balancing counterforce may be applied by an air pressure acting on a surface of the second amount of the fluid.

The fluid pressure $P_u$ may be provided by arranging the second amount of the fluid at a certain height above the nozzle, which height is actively maintained in printing operation. In case the second amount of the fluid is released a hydrostatic pressure is provided in the nozzle by the height of the second amount of the fluid. The fluid pressure $P_u$ may also be provided by biasing a spring loaded element, for example a membrane, against the second amount of the fluid. For example the membrane may be resiliently deflected. A deflected state of the membrane may be maintained by a counterforce provided by the pre-tension means. For example a counterforce may be applied by an air pressure acting on an outer side of the membrane.

The pre-tension means is controlled such that in a power down situation a fluid pressure $P_u$ is provided, that is capable for overflowing the nozzle plate and subsequently forming a film on the nozzle plate. In particular the fluid pressure $P_u$ is adapted in order to overcome retaining forces of the fluid in the nozzle, such as a capillary force between the fluid and the nozzle.

The printing system according to the invention provides that in a power down situation the nozzle plate is overflown due to the fluid pressure $P_u$ provided on the nozzle thereby forming a film on the nozzle plate containing said third amount of fluid. In particular the pre-tension means is adapted, such that in a power down situation in an embodiment the nozzle plate may be partially overflown due to the fluid pressure $P_u$, and in another embodiment the nozzle plate may be completely overflown due to the fluid pressure $P_u$.

Preferably the second amount of the fluid may be suitably selected based on said desired third amount of fluid of the fluid film formed on the nozzle plate. As a result the fluid film formed on the nozzle plate may be retained on the nozzle plate and does not lead to contamination of the printing system by dripping of fluid from the print head in the power down situation while the recovery of the print head is enhanced by the fluid film on the nozzle plate.

In an embodiment of the printing system, the printing system further comprises a control unit configured for selecting the positive fluid pressure $P_u$ based on a surface tension $\gamma$ of the fluid and the radius r of the nozzle in order that the positive fluid pressure $P_u$ on the meniscus of the fluid in the nozzle is at least larger than $2\gamma/r$ and controlling the pre-tension means for adjusting the pre-tension state based on the selected positive fluid pressure $P_u$.

As such the fluid pressure $P_u$ overcomes the retaining capillary forces of the fluid in the nozzle. As used herein a surface tension is a static surface tension between the fluid and air as can be measured using a bubble pressure tensiometer.

In an embodiment of the printing system, wherein the printing system further comprises a releasing means configured for releasing the second amount of the fluid in the second fluid storing section in response to the power down situation, thereby providing the fluid pressure $P_u$ acting on the meniscus of the fluid in the nozzle and overflowing the nozzle plate by said third amount of the fluid.

The releasing means are configured for releasing the second amount of the fluid in response to a power down situation.

For example the fluid pressure $P_u$ may be restrained by providing a negative air pressure acting on the second amount of the fluid. The negative air pressure may remain even in case of a power down situation (for example in a closed air pressure chamber). In such case the releasing means may be a fail to open air valve which provides a connection of the air pressure chamber to ambient air, wherein the air valve is closed by active control in printing operation and the air valve automatically opens in response to a power down situation.

In an alternative example the releasing means comprises a electromagnetic element. Said electromagnetic element is activated in a printing operation in order to retain the second amount of the fluid in the second fluid storing section in a pre-tension state (for example a pre-tension position of the second fluid storing section). In a power down situation the electromagnetic element is automatically not activated anymore (fail to release control). As a result the second amount of the fluid is not retained in the second fluid storing section in the power down situation and subsequently provides said positive fluid pressure $P_u$ acting on the meniscus of the fluid in the nozzle.

In an embodiment of the printing system, wherein the nozzle plate comprises a non-wetting portion, which non-wetting portion encloses the nozzle. The non-wetting portion restricts the fluid flowing over the nozzle plate and as such provides an outer boundary to the film being formed on the nozzle plate around the nozzle. Preferably the nozzle plate further comprises a wetting portion, wherein the non-wetting portion encloses the wetting portion and the wetting portion encloses the nozzle. The wetting portion enhances the film forming and definition of the film dimensions.

The non-wetting portion may have a boundary arranged around the nozzle, which boundary is configured for confining the film of fluid on the nozzle plate, thereby covering the nozzle. In an example the non-wetting portion may have a substantially circular boundary arranged around the nozzle, the boundary enclosing a round area which has a diameter w. A film of fluid being formed on the nozzle plate up to the boundary will encounter a film retaining pressure $P_f$ which is equal to $4\gamma/w$ based on the surface tension $\gamma$ of the fluid and the diameter w of the round area.

In a particular embodiment the fluid pressure $P_u$ is suitably selected to be smaller than a film retaining pressure $P_f$, which is provided by the non-wetting portion. This embodiment enhances a control on the position and size of the film of fluid formed on the nozzle plate and reduces the risk of contaminating the printing system.

In an embodiment of the printing system, wherein the second amount of the fluid in printing operation is arranged higher than the nozzle thereby providing a hydrostatic fluid pressure on the meniscus of the fluid in the nozzle, and wherein the pre-tension means comprises an upper level maintaining means for in printing operation maintaining an upper level of the second amount of the fluid at a predetermined height above the meniscus of the fluid in the nozzle, wherein the predetermined height is adapted such that the hydrostatic fluid pressure on the meniscus of the fluid in the nozzle is at least larger than $2\gamma/r$. This embodiment provides an easy and accurate control on the hydrostatic fluid pressure $P_u$ in the nozzle by adapting the upper level of the second amount of the fluid. The upper level maintaining means provides a counterforce for balancing the fluid pressure $P_u$ in printing operation thereby maintaining the upper level substantially stationary.

In an embodiment of the printing system, the printing system further comprises a sensor for detecting the upper level of the second amount of the fluid, the sensor sending a signal to the control unit based on the detected upper level. The sensor supports the accurate control of the upper level by the control unit by means of the upper level maintaining means. The sensor may be an optical sensor, may be an electrical conductive sensor, may be a mechanical sensor or may be any other sensor.

In an embodiment of the printing system, the pre-tension means further comprises a fluid pump means configured for in operation moving fluid to the second fluid storing section, thereby adjusting the upper level of the second amount of the fluid. The fluid pump means provides a simple means for both controlling the second amount of the fluid in the second fluid storing section and for accurately adjusting the upper level of the second amount of the fluid in the second fluid storing section.

In an embodiment of the printing system, the upper level maintaining means is an air pressure means, the air pressure means providing in printing operation a negative air pressure in the second fluid storing section above the upper level of the second amount of the fluid. The air pressure means provides a simple and accurate control for maintaining the upper level by providing a negative air pressure counterforce to the hydrostatic fluid pressure $P_u$.

In a particular embodiment the releasing means is an air pressure releasing means for releasing the negative air pressure in the second fluid storing section in response to a power down.

In a particular embodiment the upper level maintaining means and the releasing means both comprise a electromagnetic element. Said electromagnetic element is configured for maintaining in printing operation an upper level of the second amount of the fluid at a predetermined height above the meniscus of the fluid in the nozzle. And said electromagnetic element is configured for releasing the second amount of the fluid in response to a power down situation.

In an embodiment of the printing system, the second fluid storing section comprises a floating element, which is floatingly supported by the second amount of the fluid. The floating element reduces evaporation of the fluid at the upper level. In an alternative embodiment, the second fluid storing section comprises a piston, which is movably arranged in the second fluid storing section in contact with the upper level of the second amount of the fluid. The piston even further restrains evaporation of the fluid at the upper level. The piston may be moved by mechanical force, by fluid pressure or by air pressure provided onto the piston.

In an embodiment of the printing system, the pre-tension means includes a closed upper end of the second fluid storing section, which closed upper end is movably arranged in a height direction with respect to the nozzle, and wherein the upper level maintaining means is configured for maintaining the closed upper end of the second fluid storing section at the predetermined height above the meniscus of the fluid in the nozzle. For example the second fluid storing section may be a tube having a closed upper wall. The tube is movably arranged in a height direction with respect to the first fluid storing section and may be partially or completely nested in the first fluid storing section. In case the tube is raised, and the tube is filled by fluid up to the closed upper end wall, accordingly the upper level of the second amount of the fluid is raised.

In an embodiment of the printing system, wherein the second fluid storing section comprises a tube portion for retaining the second amount of the fluid, wherein the tube portion has a mean diameter which is smaller than 10 mm, the mean diameter of the tube being preferably smaller than 5 mm. The diameter of the tube portion being smaller than 10 mm restricts the volume of the second amount of the fluid thereby reducing a contamination of the printing system by the fluid which overflows the nozzle plate in case of a power down situation. The mean diameter may be in the range between 1 mm and 10 mm, more preferably in the range between 1 mm and 5 mm or alternatively may be in the range between 5 mm and 10 mm.

In an embodiment of the printing system, wherein the first fluid storing section comprises a membrane, and wherein the pre-tension means comprises a membrane deflecting means being configured for in printing operation deflecting the membrane, thereby forming said second fluid storing section for containing the second amount of the fluid, the deflected membrane inducing a membrane fluid pressure $P_m$ on the meniscus of the fluid in the nozzle, which is adapted for overflowing the nozzle plate, the pre-tension means in printing operation restraining the membrane fluid pressure $P_m$ from acting on the meniscus of the fluid in the nozzle.

The membrane may be arranged in one of the walls of the first fluid storing section. Due to the deflection of the membrane a second fluid storing section is formed in connection to the first fluid storing section as the membrane of the first fluid storing section is deflected outwards.

The membrane deflecting means may for example comprise an air pressure chamber, which preferably is arranged adjacent to one side of the membrane. A negative air pressure may be provided in the air pressure chamber, such that the membrane deflects into the air pressure chamber. Alternatively the membrane deflecting means may comprise a spring element which is arranged in connection to the membrane. The membrane is an elastic element and provides a membrane fluid pressure $P_m$ acting on the second amount of the fluid in case the membrane is deflected. In this embodiment the membrane fluid pressure $P_m$ provides the fluid pressure $P_u$ on the nozzle for overflowing the nozzle plate.

In another aspect of the invention a method is provided for operating a printing system according to the invention, wherein the method comprises the steps of:

a) providing the fluid in the pressure chamber of the print head, thereby forming a meniscus of the fluid in the nozzle;
b) providing a first amount of the fluid in the first fluid storing section;
c) arranging a second amount of the fluid in the second fluid storing section, thereby inducing a positive fluid pressure $P_u$ with respect to the meniscus of the fluid in the nozzle, which positive fluid pressure $P_u$ is selected such that a third amount of the fluid passes through the nozzle in response to said positive fluid pressure $P_u$ in a power down situation and forms a film on the nozzle plate; and
d) retaining in printing operation the second amount of the fluid inside the second fluid storing section, thereby in printing operation restraining the positive fluid pressure $P_u$ from acting on the meniscus of the fluid in the nozzle.

The second amount of the fluid is retained in the second fluid storing section during printing operation. For example the second amount of the fluid may be retained by providing a negative air pressure acting on the second amount of the fluid.

In response to a power down situation the second amount of the fluid is released. In said situation the fluid pressure $P_u$ of the second amount of the fluid pushes the fluid in the pressure chamber through the nozzle, onto the nozzle plate. As a result a fluid film is formed on the nozzle plate by said third amount of fluid.

The first amount of the fluid, which is provided in the first fluid storing section, may be obtained by partially filling or by completely filling the first fluid storing section. Preferably the fluid, which is provided in the pressure chamber, is supplied and replenished by the fluid which is available in the first fluid storing section.

The second amount of the fluid, which is arranged in the second fluid storing section, may be supplied from the first fluid storing section and may be supplied to the second fluid storing section in any other way independently of the first fluid storing section. The second amount of the fluid in the second fluid storing section induces a fluid pressure $P_u$ on the meniscus of the fluid in the nozzle. In an example the fluid pressure $P_u$ may be obtained by arranging the second amount of the fluid at a suitably selected height above the meniscus of the fluid in the nozzle such that a hydrostatic fluid pressure is induced on the meniscus of the fluid in the nozzle.

In an embodiment of the method, wherein step c) comprises arranging an upper level of the second amount of the fluid at a predetermined height above the meniscus of the fluid in the nozzle, thereby inducing a hydrostatic fluid pressure on the meniscus of the fluid in the nozzle; and step d) comprises maintaining the upper level of the second amount of the fluid at the predetermined height, thereby restraining the hydrostatic fluid pressure from acting on the meniscus of the fluid in the nozzle, wherein the hydrostatic fluid pressure is at least larger than $2\gamma/r$, wherein $\gamma$ is the surface tension of the fluid and r is the radius of the nozzle.

The selection of the predetermined height is a simple method to provide a hydrostatic fluid pressure $P_u$ on the meniscus of the fluid in the nozzle which overcomes the retaining capillary forces of the fluid in the nozzle.

In an embodiment of the method, step d) comprises providing a negative air pressure in the second fluid storing section above the upper level such that the upper level of the second amount of the fluid is maintained at the predetermined height. The air pressure provides an accurately controlled counterforce to the upper level for balancing the hydrostatic fluid pressure $P_u$. As a result the upper level is accurately maintained at the predetermined height.

In an embodiment of the method, the second fluid storing section comprises a closed upper end, and wherein step c) comprises moving the closed upper end of the second fluid storing section upwards to the upper level, thereby filling the second fluid storing section with the second amount of the fluid, and wherein step d) comprises retaining the closed upper end substantially at the upper level. This embodiment provides both control on the hydrostatic fluid pressure $P_u$ and restrains evaporation of the second amount of the fluid in the second fluid storing section.

In an embodiment of the method, wherein the first fluid storing section comprises a membrane, and wherein step c) comprises deflecting the membrane, thereby forming said second fluid storing section containing said second amount of the fluid and wherein the positive fluid pressure $P_u$ comprises a membrane fluid pressure $P_m$ based on the deflected membrane; and wherein step d) comprises maintaining the membrane in the deflected state, thereby restraining the membrane fluid pressure $P_m$ from acting on the meniscus of the fluid in the nozzle.

The second fluid storing section may be formed in connection to the first fluid storing section in case the membrane is deflected outwards from the first fluid storing section. The membrane may be in direct contact to the fluid contained in the first fluid storing section. The second amount of the fluid is contained in the second fluid storing section due to the forming of the second fluid storing section.

In this embodiment the membrane fluid pressure $P_m$ may be adapted based on a deflection amount of the membrane for overflowing the nozzle plate. Furthermore attributes of the membrane (dimensions, elastic properties) may be suitably selected based on a desired membrane fluid pressure $P_m$ and a desired third amount of the fluid in the film (e.g. a relatively small amount of the fluid). The advantage is that a membrane fluid pressure $P_m$ may be obtained which is sufficient to overcome capillary forces of the fluid in the nozzle independently from a suitably selected second amount of the fluid, which induces said third amount of fluid forming a stable film on the nozzle plate without dripping from the print head.

Further scope of applicability of the present invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given herein below and the accompanying schematical drawings which are given by way of illustration only, and thus are not limitative of the present invention, and wherein.

DETAILED DESCRIPTION OF EMBODIMENTS

Figure 1A:
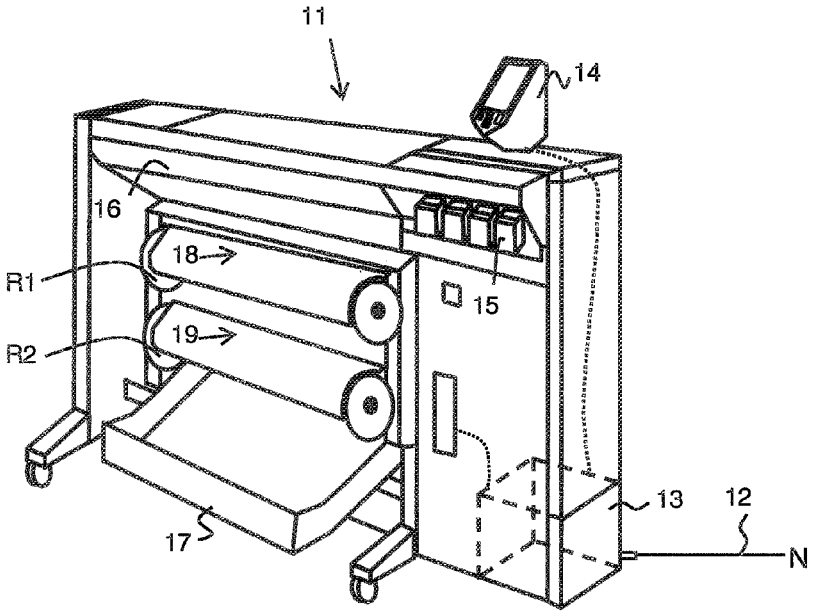
FIG. 1A shows an image forming apparatus, wherein printing is achieved using a wide format inkjet printer.

The present invention will now be described with reference to the accompanying drawings, wherein the same reference numerals have been used to identify the same or similar elements throughout the several views.

Figure 1B:
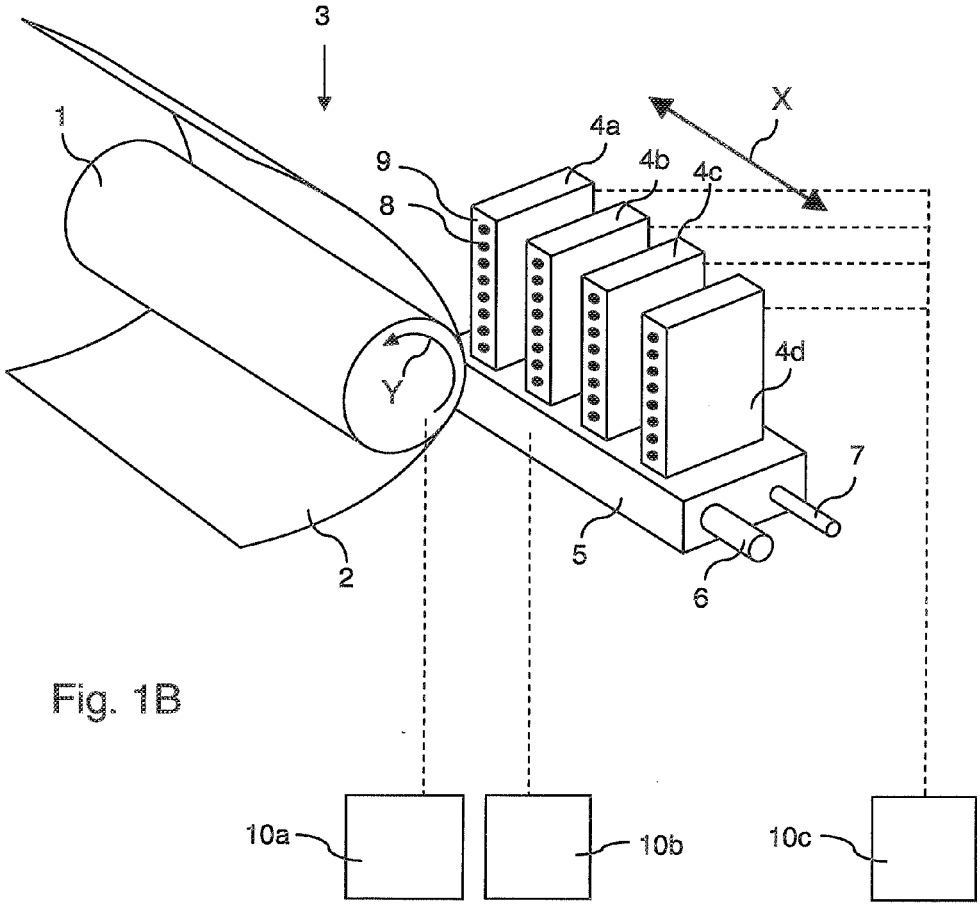
FIG. 1B shows an ink jet printing assembly.

FIG. 1A shows an image forming apparatus 11, wherein printing is achieved using a wide format inkjet printer. The wide-format image forming apparatus 11 comprises a housing 16, wherein the printing assembly, for example the ink jet printing assembly shown in FIG. 1B is placed. The image forming apparatus 11 also comprises a storage means for storing image receiving member 18, 19, a delivery station to collect the image receiving member 18, 19 after printing and storage means for marking material 15. In FIG. 1A, the delivery station is embodied as a delivery tray 17. Optionally, the delivery station may comprise processing means for processing the image receiving member 18, 19 after printing, e.g. a folder or a puncher. The wide-format image forming apparatus 11 furthermore comprises means for receiving print jobs and optionally means for manipulating print jobs. These means may include a user interface unit 14 and/or a control unit 13, for example a computer.

Images are printed on a image receiving member, for example paper, supplied by a roll 18, 19. The roll 18 is supported on the roll support R1, while the roll 19 is supported on the roll support R2. Alternatively, cut sheet image receiving members may be used instead of rolls 18, 19 of image receiving member. Printed sheets of the image receiving member, cut off from the roll 18, 19, are deposited in the delivery tray 17.

Each one of the marking materials for use in the printing assembly are stored in four containers 15 arranged in fluid connection with the respective print heads for supplying marking material to said print heads.

The local user interface unit 14 is integrated to the print engine and may comprise a display unit and a control panel. Alternatively, the control panel may be integrated in the display unit, for example in the form of a touch-screen control panel. The local user interface unit 14 is connected to a control unit 13 placed inside the printing apparatus 11. The control unit 13, for example a computer, comprises a processor adapted to issue commands to the print engine, for example for controlling the print process. The image forming apparatus 11 may optionally be connected to a network N. The connection to the network N is diagrammatically shown in the form of a cable 12, but nevertheless, the connection could be wireless. The image forming apparatus 11 may receive printing jobs via the network. Further, optionally, the controller of the printer may be provided with a USB port, so printing jobs may be sent to the printer via this USB port.

FIG. 1B shows an ink jet printing assembly 3. The ink jet printing assembly 3 comprises supporting means for supporting an image receiving member 2. The supporting means are shown in FIG. 1B as a platen 1, but alternatively, the supporting means may be a flat surface. The platen 1, as depicted in FIG. 1B, is a rotatable drum, which is rotatable about its axis as indicated by arrow A. The supporting means may be optionally provided with suction holes for holding the image receiving member in a fixed position with respect to the supporting means. The ink jet printing assembly 3 comprises print heads 4*a*-4*d*, mounted on a scanning print carriage 5. The scanning print carriage 5 is guided by suitable guiding means 6, 7 to move in reciprocation in the main scanning direction B. Each print head 4*a*-4*d* comprises an orifice surface 9, which orifice surface 9 is provided with at least one orifice 8. The print heads 4*a*-4*d* are configured to eject droplets of marking material onto the image receiving member 2. The platen 1, the carriage 5 and the print heads 4*a*-4*d* are controlled by suitable controlling means 10*a*, 10*b* and 10*c*, respectively.

The image receiving member 2 may be a medium in web or in sheet form and may be composed of e.g. paper, cardboard, label stock, coated paper, plastic or textile. Alternatively, the image receiving member 2 may also be an intermediate member, endless or not. Examples of endless members, which may be moved cyclically, are a belt or a drum. The image receiving member 2 is moved in the sub-scanning direction A by the platen 1 along four print heads 4*a*-4*d* provided with a fluid marking material.

A scanning print carriage 5 carries the four print heads 4*a*-4*d* and may be moved in reciprocation in the main scanning direction B parallel to the platen 1, such as to enable scanning of the image receiving member 2 in the main scanning direction B. Only four print heads 4*a*-4*d* are depicted for demonstrating the invention. In practice an arbitrary number of print heads may be employed. In any case, at least one print head 4*a*-4*d* per color of marking material is placed on the scanning print carriage 5. For example, for a black-and-white printer, at least one print head 4*a*-4*d*, usually containing black marking material is present. Alternatively, a black-and-white printer may comprise a white marking material, which is to be applied on a black image-receiving member 2. For a full-color printer, containing multiple colors, at least one print head 4*a*-4*d* for each of the colors, usually black, cyan, magenta and yellow is present. Often, in a full-color printer, black marking material is used more frequently in comparison to differently colored marking material. Therefore, more print heads 4*a*-4*d* containing black marking material may be provided on the scanning print carriage 5 compared to print heads 4*a*-4*d* containing marking material in any of the other colors. Alternatively, the print head 4*a*-4*d* containing black marking material may be larger than any of the print heads 4*a*-4*d*, containing a differently colored marking material.

The carriage 5 is guided by guiding means 6, 7. These guiding means 6, 7 may be rods as depicted in FIG. 1B. The rods may be driven by suitable driving means (not shown). Alternatively, the carriage 5 may be guided by other guiding means, such as an arm being able to move the carriage 5. Another alternative is to move the image receiving material 2 in the main scanning direction B.

Each print head 4*a*-4*d* comprises an orifice surface 9 having at least one orifice 8, in fluid communication with a pressure chamber containing fluid marking material provided in the print head 4*a*-4*d*. On the orifice surface 9, a number of orifices 8 is arranged in a single linear array parallel to the sub-scanning direction A. Eight orifices 8 per print head 4*a*-4*d* are depicted in FIG. 1B, however obviously in a practical embodiment several hundreds of orifices 8 may be provided per print head 4*a*-4*d*, optionally arranged in multiple arrays. As depicted in FIG. 1B, the respective print heads 4*a*-4*d* are placed parallel to each other such that corresponding orifices 8 of the respective print heads 4*a*-4*d* are positioned in-line in the main scanning direction B. This means that a line of image dots in the main scanning direction B may be formed by selectively activating up to four orifices 8, each of them being part of a different print head 4*a*-4*d*. This parallel positioning of the print heads 4*a*-4*d* with corresponding in-line placement of the orifices 8 is advantageous to increase productivity and/or improve print quality. Alternatively multiple print heads 4*a*-4*d* may be placed on the print carriage adjacent to each other such that the orifices 8 of the respective print heads 4*a*-4*d* are positioned in a staggered configuration instead of in-line. For instance, this may be done to increase the print resolution or to enlarge the effective print area, which may be addressed in a single scan in the main scanning direction. The image dots are formed by ejecting droplets of marking material from the orifices 8.

Upon ejection of the marking material, some marking material may be spilled and stay on the orifice surface 9 of the print head 4*a*-4*d*. The ink present on the orifice surface 9 may negatively influence the ejection of droplets and the placement of these droplets on the image receiving member 2. Therefore, it may be advantageous to remove excess of ink from the orifice surface 9. The excess of ink may be removed for example by wiping with a wiper and/or by application of a suitable anti-wetting property of the surface, e.g. provided by a coating.

Figure 2A:
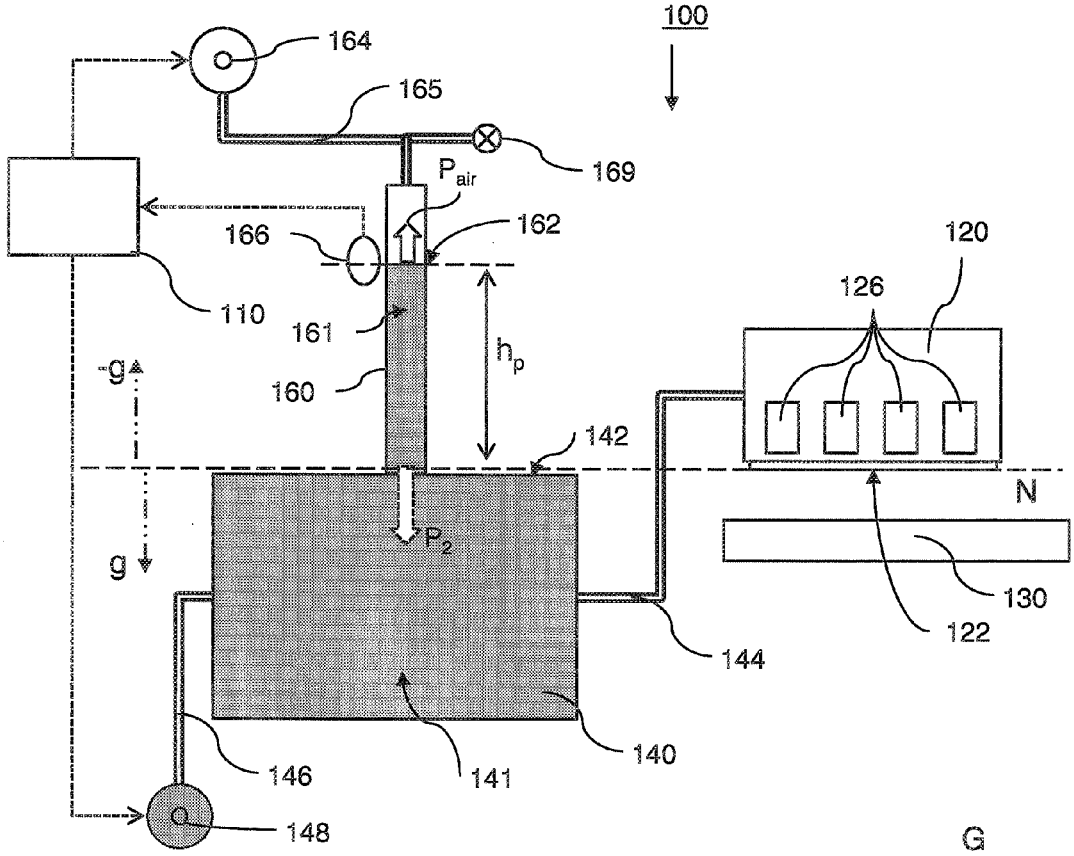
FIGS. 2A and 2B shows a printing system according to a first embodiment of the invention.
Figure 2B:
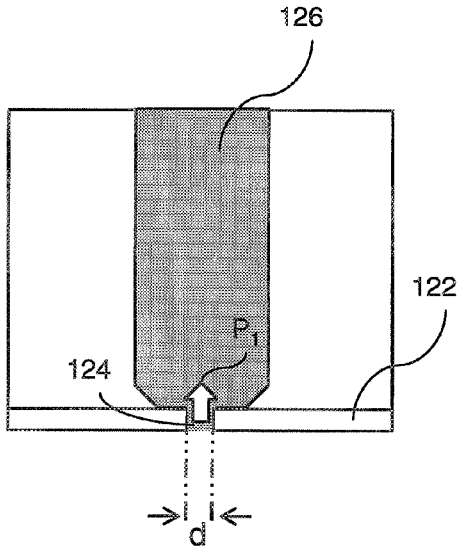

FIGS. 2A and 2B shows a printing system according to a first embodiment of the invention. FIG. 2A shows a printing system 100 comprising a print head 120, a first fluid storing section 140 and a second fluid storing section 160. The print head 120 comprises a nozzle plate 122, which comprises a plurality of nozzles 124, and a plurality of pressure chambers 126. Each pressure chamber 126 is in fluid communication to one of the plurality of nozzles 124 (as is also shown in FIG. 2B). Each nozzle 124 has a diameter d. The print head 120 is in printing operation arranged above a printing surface 130, wherein the nozzle plate 122 faces the printing surface 130. The print head 120 may be a scanning print head or may be an inline print head which is stationary arranged above the printing surface 130. A fluid is present in each of the pressure chambers 126 and correspondingly in each of the nozzles 124. The nozzle 124 contains a meniscus of the fluid.

Each of the nozzles 124 of the print head 120 is arranged in parallel to each other at a certain level N above the ground level G. A gravity force is acting from the level N downwards in a direction g (i.e. perpendicular to the level N). A distance of an element (solid or fluid material) in the direction g below the level N is referred to as a height below the nozzles 124. A distance of an element (solid or fluid material) in a direction −g above the level N is referred to as a height of the element above the plurality of nozzles 124.

The first fluid storing section 140 contains a first amount of the fluid 141. The fluid is supplied to the first fluid storing section 140 through a tube 146 and by means of a fluid pump 148. The fluid pump 148 is controlled by the control unit 110. The first fluid storing section 140 is in fluid connection to the print head 120 and to each of the plurality of pressure chambers 126 through a fluid tube 144. The first amount of the fluid 141 has an upper level 142, which is arranged at a certain height in the direction g below the level N of the plurality of nozzles 124. Due to the arrangement of the first amount of the fluid 141 (i.e. the upper level 142) below the level N, the first amount of the fluid 141 provides a negative fluid pressure $P_1$ on the meniscus of the fluid, which is present in the nozzles 124, based on the upper level 142 of the first amount of the fluid 141 (as indicated by the arrow $P_1$ in FIG. 2B). Due to the negative fluid pressure $P_1$ on the meniscus of the fluid in the nozzles 124, any fluid present in the nozzles 124 is retained in the nozzles during a standby situation of the print head 120. As such the fluid does not overflow the nozzle plate 122 in a standby situation and during printing operation of the pressure chambers 126.

The second fluid storing section 160 is connected to the first fluid storing section 140. The second fluid storing section 160 is in fluid communication to the print head 120 and to each of the each of the plurality of pressure chambers 126 through the first fluid storing section 140 and the fluid tube 144. The second fluid storing section 160 contains a second amount of the fluid 161 in a pre-tension state. The second amount of the fluid 161 may be supplied to the second fluid storing section 160 by providing a fluid pressure in the first fluid storing section 140 by means of fluid pump 148. The second amount of the fluid 161 in the pre-tension state has an upper level 162, which is arranged at a certain height h in the direction −g above the level N of the plurality of nozzles 124. Due to the arrangement of the second amount of the fluid 161 (i.e. the upper level 162) above the level N, the second amount of the fluid 161 provides a fluid pressure $P_u$ on the meniscus of the fluid, which is present in the nozzles 124, based on the upper level 162 of the second amount of the fluid 161. In fact the fluid pressure $P_u$ is also present at the level N around the interface from the second fluid storing section 160 to the first fluid storing section 140 (as indicated by the arrow $P_u$ in FIG. 2A). The fluid pressure $P_u$ in this embodiment is provided by a hydrostatic fluid pressure $P_2$. A hydrostatic fluid pressure $P_2$ is the pressure exerted by a fluid at equilibrium due to the force of gravity. The hydrostatic fluid pressure $P_2$ is proportionally to the height h [m] of the upper level 162 with respect to the level N, to the fluid density ρ [kg/m$^3$] of the second amount of the fluid 161 and to the gravitational acceleration constant $g_c$ (i.e. 9.8 m/s$^2$). Thus the hydrostatic fluid pressure $P_2=h\times\rho\times g_c$ [mbar].

The upper level 162 of the second amount of the fluid 161 is maintained stationary in the second fluid storing section 160 with respect to the level N by providing a negative air pressure $P_{air}$ in the second fluid storing section 160 above the upper level 162 of the second amount of the fluid 161. The negative air pressure $P_{air}$ is provided in the second fluid storing section 160 by air pump 164 through an air channel 165. The air pump 164 is controlled by the control unit 110.

An upper level sensor 166 is arranged near to the second fluid storing section 160 and is configured to sense the upper level 162 of the second amount of the fluid 161. In an example the upper level sensor 166 is an optical sensor, which determines the position of the upper level 162. The upper level sensor 166 provides a signal to the control unit 110 concerning the sensed position of the upper level 162. The control unit 110 determines the height h of the upper level 162 with respect to the level N based on the signal received from the upper level sensor 166.

The negative air pressure $P_{air}$ is controlled by the control unit 110 such that the upper level 162 is maintained at a predetermined height $h_p$ above the level N. As a result of the negative air pressure $P_{air}$ the hydrostatic fluid pressure is restrained from acting on the first fluid storing section 140 and on the meniscus of the fluid in the nozzles 124. In case the upper level 162 is descending accidently during printing operation, the control unit 110 may operate the air pump 164 for raising the air pressure $P_{air}$ in the second fluid storing section 160 until the upper level 162 has returned to the predetermined height $h_p$. Alternatively the control unit 110 may operate fluid pump 148 for raising a fluid pressure in the first fluid storing section 140 and supplying fluid towards the second fluid storing section 160, thereby raising the upper level 162 in the second fluid storing section 160.

The hydrostatic fluid pressure $P_2$ is selected by the control unit 110 during printing operation for overflowing the nozzle plate 122 in a power down situation. The hydrostatic fluid pressure needs to overcome capillary forces of the meniscus of the fluid in the nozzle 124 in order to overflow the nozzle plate 122. A capillary force of fluid in the nozzle $F_N$ is proportional to the radius r of the nozzle 124, which is the half of the diameter d of the nozzle 124, and is proportional to the surface tension γ of the fluid in the nozzle 124. The capillary force in the nozzle $F_N=4\gamma/d$.

The control unit 110 suitably selects the hydrostatic fluid pressure $P_2$ higher than the capillary force, i.e. $>4\gamma/d$. The control unit 110 holds data about the nozzle diameter d and about the surface tension γ of the fluid. The surface tension γ is provided to the control unit 110, for example by a data storage unit of a fluid cartridge, when the fluid cartridge is loaded in the printing system. The height h is predetermined by the control unit 110 for obtaining the desired hydrostatic fluid pressure $P_2$.

Description of Surface Tension Measurement Technique

The surface tension is measured using a Sita bubble pressure tensiometer, model SITA online t60, according to the (maximum) bubble pressure method. The surface tension of the fluids to be tested (e.g. inks according to the present invention) is measured at 30° C. unless the operational temperature of the fluid is different. The static surface tension is determined at a bubble frequency of 0.2 $s^{-1}$. The surface tension measured according to this method is representative of the surface tension of the fluid-air interface.

Figure 2C:
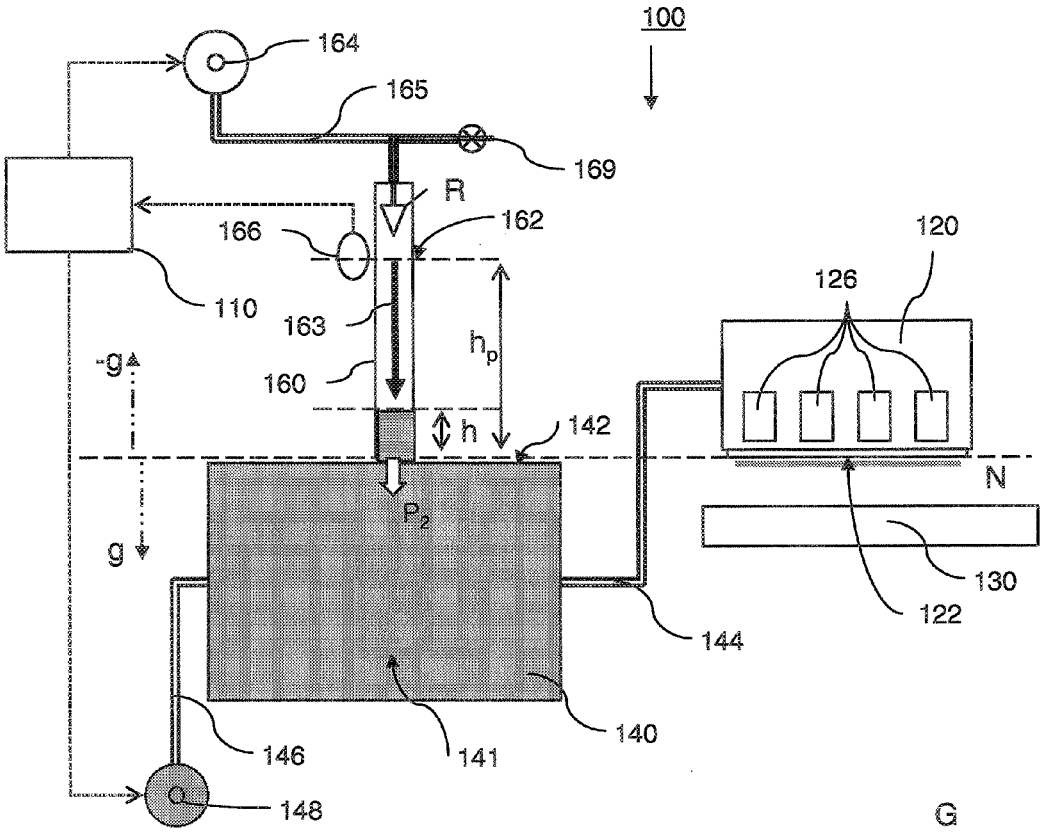
FIGS. 2C-2E show the printing system in a power down situation according to the first embodiment of the invention.
Figure 2D:
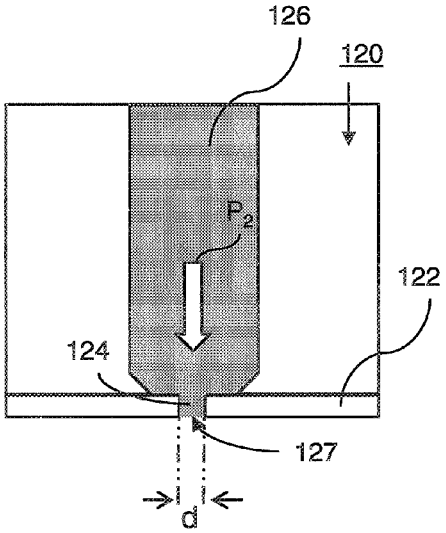
Figure 2E:
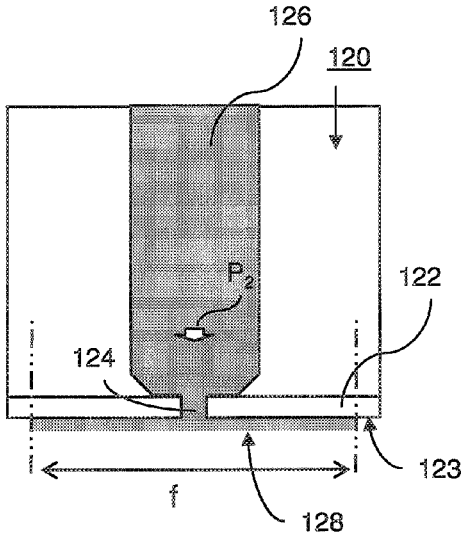

FIGS. 2C-2E show the printing system in a power down situation according to the first embodiment of the invention. In the power down situation the negative air pressure $P_{air}$ is released from the second fluid storing section 160 by opening an air valve 169 (as indicated by air flow arrow R in FIG. 2C). The air valve 169 is closed during printing operation by active control of the control unit 110. The air valve 169 automatically opens in a power down situation due to a spring element of the air valve 169 (i.e. a fail to open control valve). In the power down situation an ambient air pressure is acting on the upper level 162 of the second amount of the fluid 161.

As shown in FIG. 2D the hydrostatic fluid pressure $P_2$ starts acting on a meniscus of the fluid 127 in the nozzle 124 at the start of the power down situation in response to the air valve 169 switching to the fail open state. The meniscus of the fluid 127 in the nozzle 124 is moved outwards towards the outer surface 123 of the nozzle plate 122. The nozzle capillary force $P_N$ of the meniscus of the fluid 127 in the nozzle 124 is smaller than the hydrostatic fluid pressure $P_2$ and, as a result, the nozzle plate 122 is slowly overflown by a third amount of the fluid from the second storing section 160 through the pressure chamber 126 as shown in FIG. 2E.

As shown in FIG. 2E, a film of fluid 128 is formed on the outer surface 123 of the nozzle plate 122 surrounding and covering the nozzle 124. While the film of fluid 128 is formed on the nozzle plate 122, the upper level 162 of the second amount of the fluid 161 is descending in the second fluid storing section 160 (as indicated by arrow 163 in FIG. 2C). Due to the decreasing height h of the upper level 162 with respect to the level N, the hydrostatic fluid pressure $P_2$ on the nozzle is accordingly decreasing with respect to the initial hydrostatic fluid pressure $P_2$ based on the predetermined height $h_p$.

FIG. 2E shows the film of fluid 128 in an equilibrium state when the film 128 stops extending on the nozzle plate 122 and attains a film dimension (indicated by arrow f) at some point in time, wherein the upper level 162 has reached the level N and the hydrostatic fluid pressure $P_2$ on the nozzle and on the film of fluid 128 is accordingly decreased to substantially zero. The film of fluid 128 contains a third amount of the fluid, which is substantially equal to the second amount of the fluid 161, which was stored in the second fluid storing section 160 during printing operation. In power down situation the film of fluid 128 stays on the nozzle plate 122 and does not contaminate the printing system, such as the printing surface 130. In time some fluid in the film may dry due to ambient air, and the film may become smaller and thinner. The fluid in nozzle 124 however is protected by the film of fluid 128 and as such any drying of the fluid in the nozzle 124 is prevented or at least retarded.

In another example the print head 120 comprises a plurality of nozzles 124 and a plurality of pressure chambers 126, each nozzle 124 being connected to a pressure chamber 126. Each of the plurality of nozzles 124 is aligned at the same level N. The hydrostatic fluid pressure $P_2$ acts on the meniscus of fluid 127 of each of the plurality of nozzles 124 in case of a power down situation. Accordingly a film of fluid 128 is formed around each of the nozzles 124.

Figure 3:
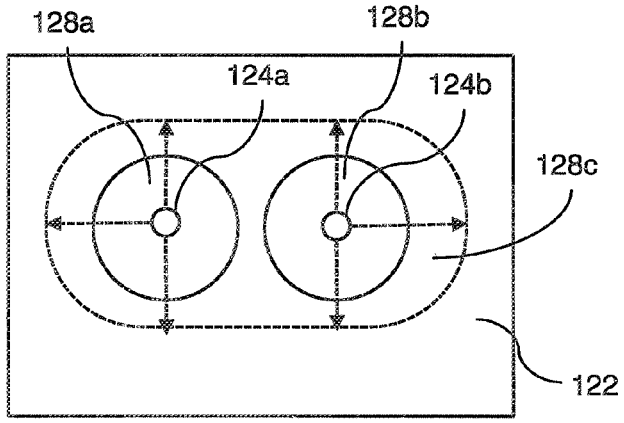
FIG. 3 shows a top plan view of a portion of the nozzle plate of the printing system according to the invention.

FIG. 3 is a top plan view of a portion of the nozzle plate 122, which comprises two nozzles 124*a*, 124*b*. In FIG. 3 another example is shown of a film of fluid. As shown in FIG. 3 a film of fluid 128*a* is extending around a nozzle 124*a* (as indicated by the arrows), which merges together with a film of fluid 128*b* extending around an adjacent nozzle 124, and together forming a joined film of fluid 128*c* on the nozzle plate 122. In similar manner a large merged film of fluid may be formed covering each of the plurality of nozzles 124 of the nozzle plate 122, wherein the joined film of fluid as a whole contains a third amount of the fluid, which is substantially equal to the second of amount of the fluid 161, which was stored in the second fluid storing section 160 during printing operation.

For example a joined film of fluid may be formed on a nozzle plate in a similar manner covering a total of 1000 nozzles, which film of fluid is covering approximately 50 $cm^2$ of nozzle plate and contains 5 ml of fluid, which is substantially equal to the second amount of the fluid 161, which was stored in the second fluid storing section 160 during printing operation.

Figure 4D:
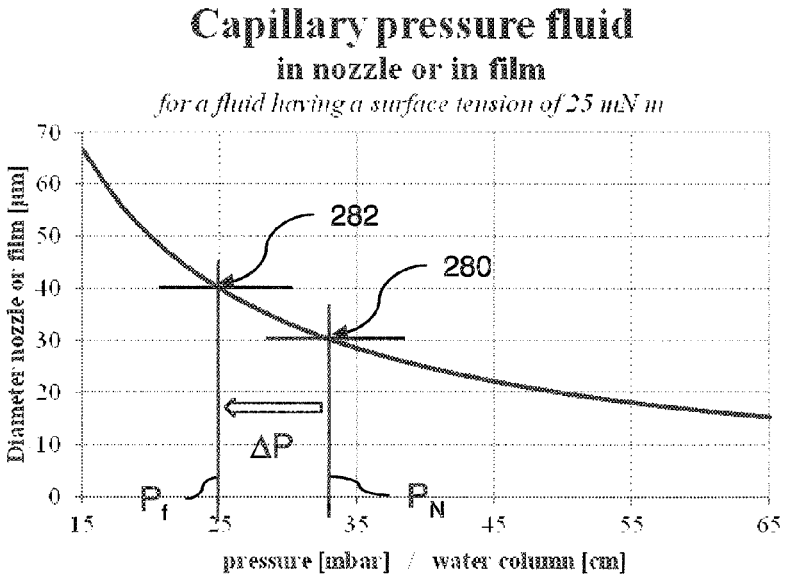
FIG. 4D shows an example of the relationship between a film capillary pressure and the diameter of a film, which is formed on the nozzle plate.
Figure 4A:
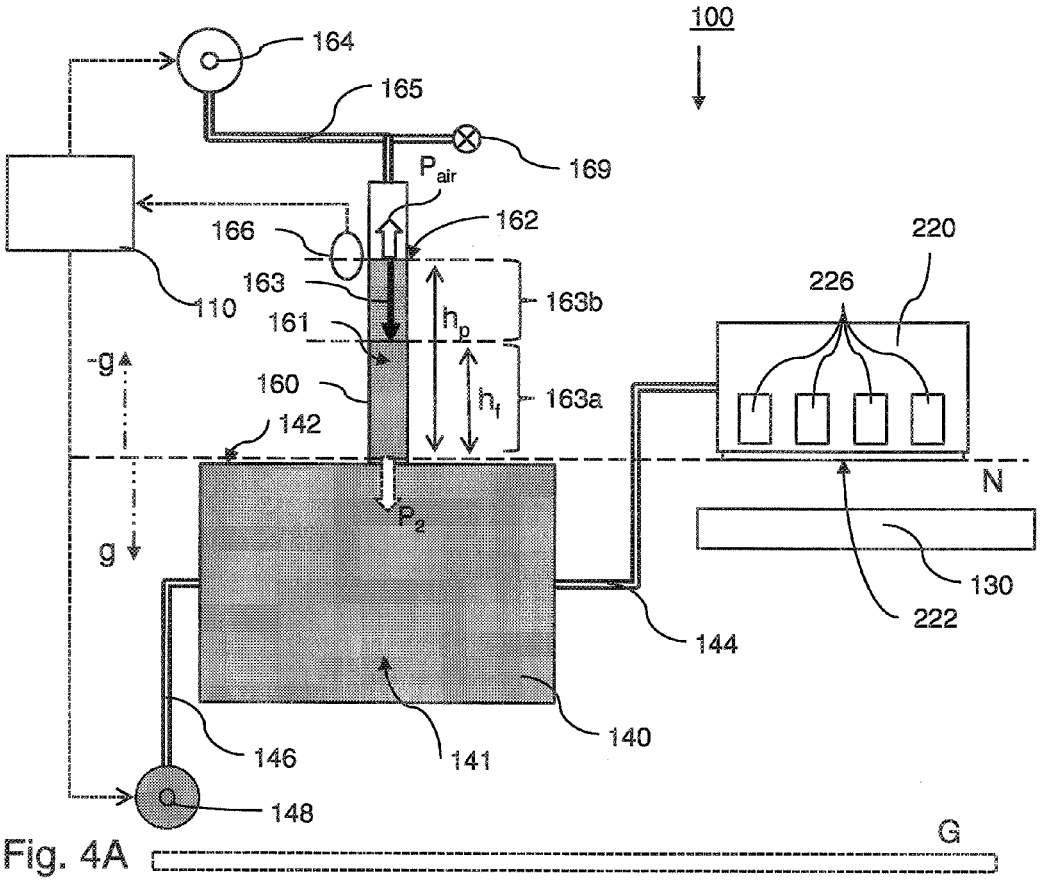
FIGS. 4A-4C show a printing system according to a second embodiment of the invention.
Figure 4B:
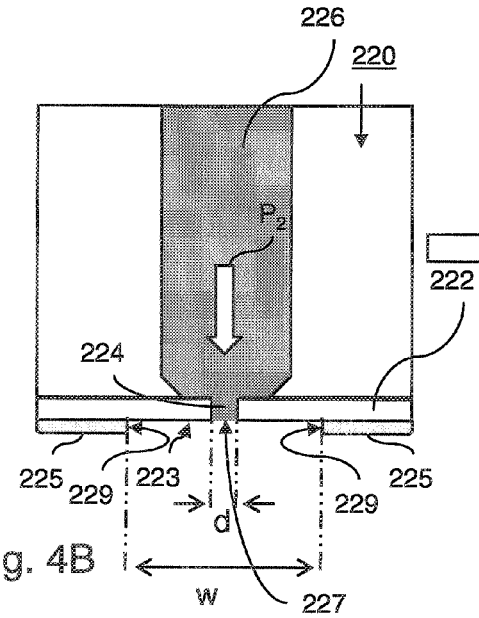
Figure 4C:
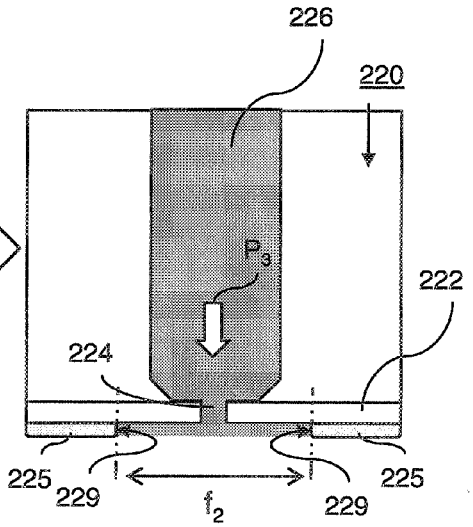

FIGS. 4A-4C show a printing system according to a second embodiment of the invention. In the second embodiment the print head 220 comprises a nozzle plate 222, wherein a part of a nozzle plate 222 is covered by a non-wetting coating 225 (as shown in FIG. 4B). The non-wetting coating 225 encloses the nozzle 224 in a circular manner, the non-wetting coating 225 having a circular boundary 229 which encloses a round area 223, which has a diameter w. Within the circular boundary 229 the outer surface of the nozzle plate 223 is adapted to be wetting for the fluid.

FIG. 4A shows the printing system in printing operation as prepared for a power down situation. The second amount of the fluid 161 is provided in the second fluid storing section 160, wherein the upper level 162 of the second amount of the fluid 161 reaches up to a predetermined height $h_p$ with respect to the level N. The upper level 162 of the second amount of the fluid 161 provides a hydrostatic fluid pressure $P_2$ which is adapted in printing operation in order to overflow the nozzle plate 222 in a power down situation (by overcoming capillary forces of the meniscus of the fluid in the nozzle 224). The upper level 162 is maintained stationary with respect to the level N by a negative air pressure $P_{air}$ in the second fluid storing section above the upper level 162. The second fluid storing section 160 and the first fluid storing section 140 are connected to the print head 220 in a similar manner as in the first embodiment.

In the power down situation the negative air pressure $P_{air}$ is released from the second fluid storing section 160 in response to a fail open state of the air valve 169 and an ambient air pressure starts acting on the upper level 162 of the second amount of the fluid 161.

As shown in FIG. 4B, the hydrostatic fluid pressure $P_2$ starts acting on the nozzle 224 at the start of the power down situation in response to a fail open state of the air valve 169. The meniscus of the fluid 227 in the nozzle 224 is moved outwards towards the outer surface 223 of the nozzle plate 222 due to the hydrostatic fluid pressure $P_2$. The nozzle capillary force $P_N$ of the meniscus of the fluid 227 in the nozzle 224 is smaller than the hydrostatic fluid pressure $P_2$ and, as a result, the nozzle plate 222 is slowly overflown by a third amount of fluid and a film of fluid 228 is formed on the outer surface 223. While the film of fluid 228 is formed on the nozzle plate 222, the upper level 162 of the second amount of the fluid 161 is descending in the second fluid storing section 160 as indicated by arrow 163.

FIG. 4C shows the film of fluid 228 in an equilibrium state when the film 228 reaches the non-wetting coating 225 and stops extending on the nozzle plate 222. The film attains a stable dimension (indicated by arrow $f_2$) and contains the third amount of fluid. The film is retained by the circular boundary 229 of the non-wetting coating 225 due to a film retaining pressure $P_f$ which is equal to $2\gamma/w$, wherein $\gamma$ is the surface tension of the fluid and the diameter w is the diameter of the area within the circular boundary 229. At the same time the upper level 162 has reached a film balancing height $h_f$ in the second fluid storing section 160 and accordingly a film hydrostatic fluid pressure $P_3$ acting on the film is obtained which is lower than the hydrostatic fluid pressure $P_2$. The film hydrostatic fluid pressure $P_3$ is equal or lower than the film retaining pressure $P_f$ (i.e. $P_3 \leq P_f$). The second fluid storing section 160 now contains a first portion of the second amount of the fluid 163*a* between film balancing height $h_f$ and the level N. A second portion of the second amount of the fluid 163*b* has been moved from the second fluid storing section to the nozzle plate 222 (i.e. volume of the first portion of the second amount of the fluid 163*a*+volume of the second portion of the second amount of the fluid 163*b* is equal to the volume of the second amount of the fluid 161). The second portion of the second amount of the fluid 163*b* is substantially equal to the third amount of fluid forming the film 228 on the nozzle plate 222.

The film diameter $f_2$ is in this embodiment larger than the nozzle diameter d. As a result the film retaining pressure $P_f$ is lower than a nozzle capillary pressure $P_N$. In order to attain a stable film dimension at the circular boundary 229, the hydrostatic fluid pressure $P_3$ has decreased to a level equal to or smaller than the film retaining pressure $P_f$ while forming the film on the wetting portion 223 of the nozzle plate 222 within the circular boundary 229.

In FIG. 4D an example is shown of a relationship between a film retaining pressure $P_f$ [in mbar] and the diameter $f_2$ of a film, which is formed on the nozzle plate. The relationship of the film retaining pressure $P_f$ is based on $4\gamma/f_2$, wherein $\gamma$ is the surface tension of the fluid and the diameter $f_2$ is the diameter of the circular film of fluid. In the example the density of the fluid is presumed to be 1 g/ml and the surface tension is presumed to be 25 mN/m. Note that in this example a hydrostatic fluid pressure of the second amount of the fluid expressed in mbar relates in number to a height of a water column with respect to level N expressed in cm (based on the fluid density of 1 g/ml).

If, in a particular example, the nozzle diameter is 30 micron, then the nozzle capillary pressure $P_N$ of the meniscus in the nozzle is 33 mbar (point 280). If the diameter w of the round area 223 within the circular boundary 229 is 40 micron, then a corresponding film of the fluid having a diameter $f_2$ of 40 micron has a film retaining pressure $P_f$ of 25 mbar (point 282). A pressure drop $\Delta P$ of the fluid between $P_N$ and $P_f$ is $\Delta P = P_N$ (33 mbar)$-P_f$(25 mbar)=8 mbar.

As a result the pressure drop between the hydrostatic fluid pressure $P_2$ and the hydrostatic fluid pressure $P_3$ of the pretension means is at least 8 mbar (under the condition that $P_2$ was adapted to be approximately 35 mbar). Accordingly the upper level 162 drops from 33 cm (or higher than 33 cm) to 25 cm (or lower than 25 cm) with respect to level N in case the film of fluid 228 is formed on the outer surface 223 of the nozzle plate 222. Likewise other suitable film hydrostatic fluid pressures $P_3$ may be derived easily based on the diameter w of the round area 223 confined by the circular boundary 229 of the non-wetting coating 225 and the surface tension of the fluid.

In the second embodiment the print head 220 comprises a plurality of nozzles 224 and a plurality of pressure chambers 226, each nozzle 224 being connected to a pressure chamber 126. Each of the plurality of nozzles 224 is aligned at the same level N. Each of the plurality of nozzles is enclosed by the non-wetting coating 225 in a circular manner, the non-wetting coating 225 having a circular boundary 229 enclosing a round area 223 which has a diameter w. Accordingly a film of fluid 228 is formed around each of the nozzles 224.

In this embodiment the sum of the plurality of films of fluid 228, each film being formed around one of the plurality of nozzles 224, contains a third amount of the fluid, which is substantially equal to the second portion of the second of amount of the fluid 163*b*, which is stored in the second fluid storing section 160 between predetermined height $h_p$ and film balancing height $h_f$ in printing operation.

In an alternative embodiment a non-wetting coating 225 may enclose a plurality of nozzles 224, wherein in a power down situation a stable film of fluid 228 may be formed which covers the plurality of nozzles 224.

Figure 7:
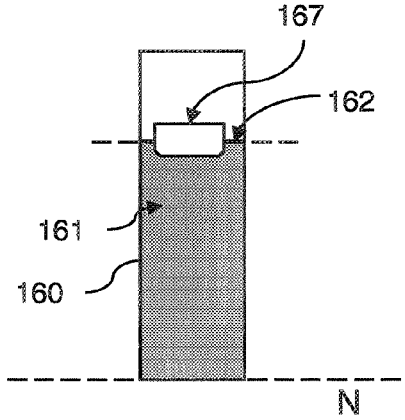
FIG. 7 shows a modification of the first embodiment or the second embodiment, wherein a floating element is provided in the second fluid storing section.

FIG. 7 shows a modification of the first embodiment or the second embodiment, wherein a floating element is provided in the second fluid storing section. In the second fluid storing section 160 the floating element 167 is arranged floatingly upon the upper level 162 of the second amount of the fluid 161. The floating element 167 is freely movably in conjunction with the upper level 162. The floating element 167 reduces evaporation of the fluid at the upper level 162. The mass of the floating element may induce an additional gravitational pressure $P_D$ on the nozzle, thereby increasing the fluid pressure $P_u$ on the meniscus of the fluid in the nozzle (i.e. $P_u = P_2 + P_D$ [mbar]).

In an alternative embodiment (not shown) the second fluid storing section 160 comprises a piston, which is freely movably arranged in the second fluid storing section 160 in contact with the upper level 162 of the second amount of the fluid. The piston even further restrains evaporation of the fluid at the upper level 162. The piston may be moved by mechanical force, by fluid pressure or by air pressure provided onto the piston.

Figure 5A:
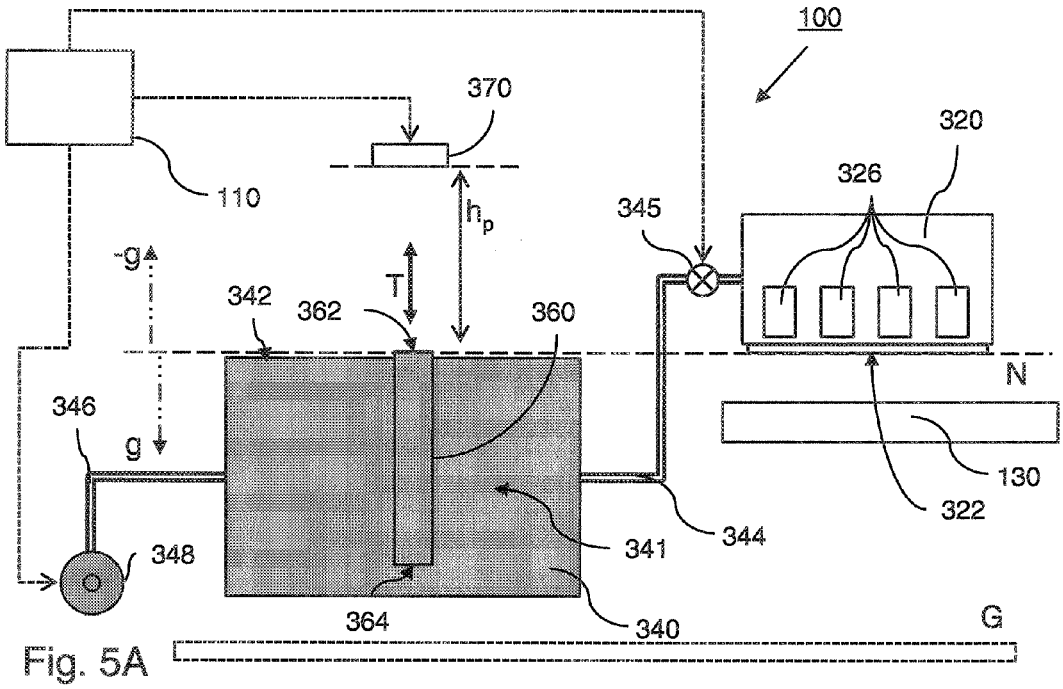
FIGS. 5A-5B show a printing system and a method for operating the printing system according to a third embodiment of the invention.
Figure 5B:
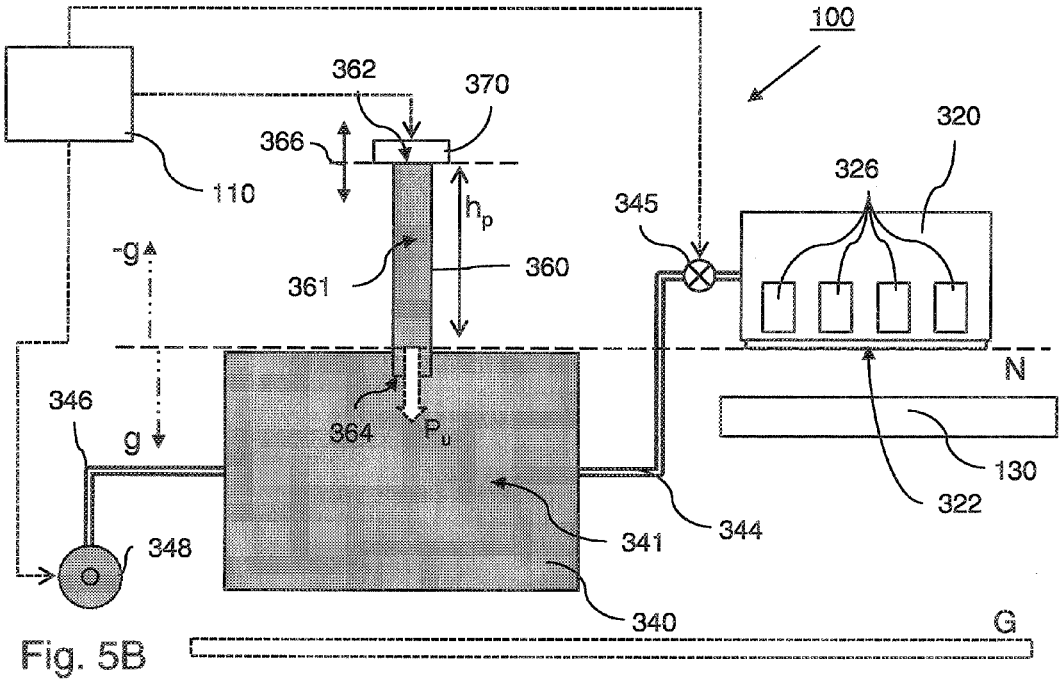

FIGS. 5A-5B show a printing system and a method for operating the printing system according to a third embodiment of the invention. In FIG. 5A the print head 320 comprises a nozzle plate 322, which may be similar to the nozzle plate 122 of the first embodiment or may be similar to the nozzle plate 222 of the second embodiment, wherein a non-wetting coating is provided on the nozzle plate.

The first fluid storing section 340 contains a first amount of the fluid 341. The first amount of the fluid 341 has an upper level 342, which is arranged at a certain height in the direction g below the level N of the plurality of nozzles 324. Due to the arrangement of the first amount of the fluid 341 below the level N, the first amount of the fluid 341 provides a negative fluid pressure $P_1$ on the meniscus of the fluid, which is present in the nozzles 324, based on the upper level 342 of the first amount of the fluid 341.

In the third embodiment of the printing system a second fluid storing section 360 is provided, having a tube shape, wherein the tube extends in the height direction (−g and g direction) and is movably arranged with respect to the height direction (as indicated by arrow T) which is perpendicular to the level N of the plurality of nozzles 324. The tube 360 has a closed upper end 362 and an open lower end 364. As such the tube 360 is in fluid communication to the first fluid storing section 340 by means of the open lower end 364.

In FIG. 5A a standby position of the tube 360 is shown. In the standby position the tube 360 is almost completely nested in the first fluid storing section 340. Only the closed upper end 362 is arranged outside the first fluid storing section 340. In printing operation of the printing system the closed upper end 362 of the tube 360 is raised up to the predetermined height $h_p$ in order to attain a pre-tension state (i.e. a pre-tension position). An electromagnetic element 370 is arranged at the predetermined height $h_p$ above the closed upper end 362.

In FIG. 5B a pre-tension state (i.e. a pre-tension position) of the second fluid storing section 360 is shown. The closed upper end 362 is raised by providing a fluid pressure in the first fluid storing section 340. The control unit 110 closes valve 345, thereby blocking the fluid communication of the first fluid storing section 340 through fluid connection 344 towards the print head 320. The control unit further operates fluid pump 348 in order to provide a fluid pressure in the first fluid storing section 340, thereby raising the closed upper end 362 up to the predetermined height $h_p$ (as shown in FIG. 5B) and filling the tube 360 by a second amount of the fluid 361, which second amount of the fluid 361 is arranged above the level N. When the closed upper end 362 has reached the electromagnetic element 370, the electromagnetic element 370 is activated by the control unit 110. The closed upper end 362 comprises a magnetic sensitive part, which is retained stationary by the activated electromagnetic element 370 with respect to the level N. Furthermore the fluid pump 348 is deactivated and the valve 345 is reopened by the control unit 110.

In this arrangement of the tube 360 (i.e. arrangement of the closed upper end 362) above the level N, the second amount of the fluid 361 induces a fluid pressure $P_u$ on the meniscus of the fluid, which fluid is present in the nozzles 324. The fluid pressure $P_u$ in the third embodiment is based on a hydrostatic fluid pressure $P_2$ due to the predetermined height $h_p$ of the closed upper end 362 and accordingly the second amount of the fluid 361 ($P_2=h\times\rho\times g_c$ [mbar]). Additionally to the hydrostatic fluid pressure $P_2$, the mass of a portion of the tube, which portion of the tube is arranged above the level N, may provide a gravitational pressure $P_T$, thereby increasing the fluid pressure $P_u$ in the nozzle (i.e. $P_u=P_2+P_T$ [mbar]).

In printing operation as shown in FIG. 5B the fluid pressure $P_u$ (including the hydrostatic fluid pressure $P_2$) is restrained by the electromagnetic element 370 from acting on the first fluid storing section 340 and on the meniscus of the fluid in the nozzles 324. The hydrostatic fluid pressure $P_2$ may be adjusted in printing operation by moving the electromagnetic element 370 together with the closed upper end of the tube 362 relatively in the height direction (as indicated by arrow 366). The height of the closed upper end of the tube 362 is adjustable to such extend that the open lower end 364 is still nested inside the first fluid storing section 340.

In a power down situation the electromagnetic element 370 is not activated anymore by the control unit 110 (i.e. fail to release control). As a result the closed upper end 362 is automatically released and the fluid pressure $P_u$ starts acting on the nozzle 324 at the start of the power down situation. As a result a film of fluid is formed on the nozzle plate around the nozzle 324 similar to the first embodiment described above and shown in FIG. 2C-2D or similar to the second embodiment described above and shown in FIG. 4B-4C, in case the nozzle plate 322 comprises a non-wetting coating, which encloses the nozzle 324. At the same time as the formation of the film of fluid the closed upper end 362 (and the tube 360) descends in a similar manner as the upper level 162 descends in the first and second embodiment towards the level N (indicated by arrow 163 shown in FIGS. 2C and 4A).

Figure 6A:
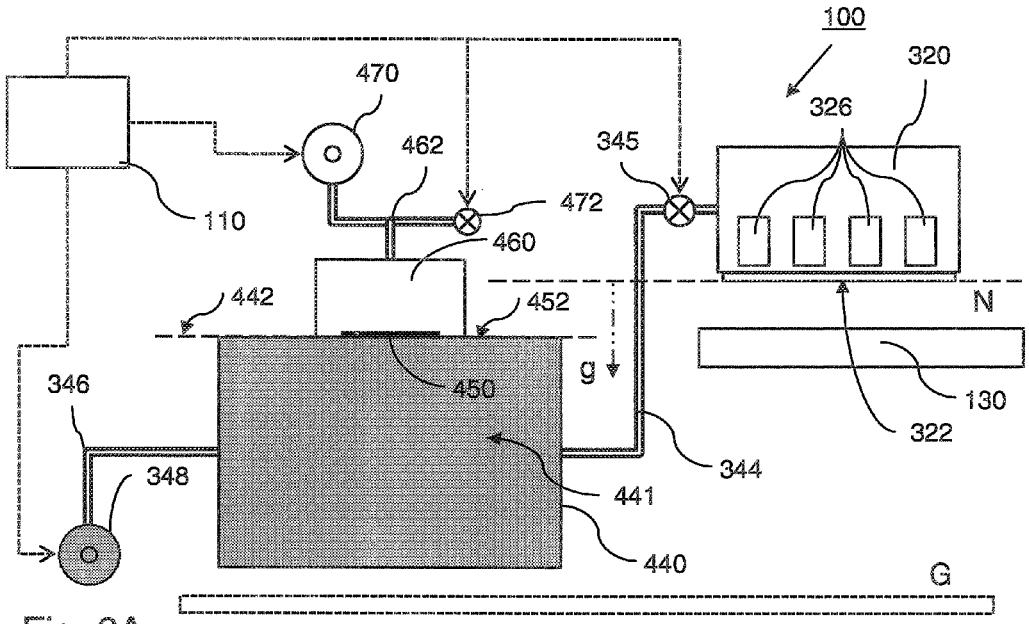
FIGS. 6A-6B show a printing system and a method for operating the printing system according to a fourth embodiment of the invention.
Figure 6B:
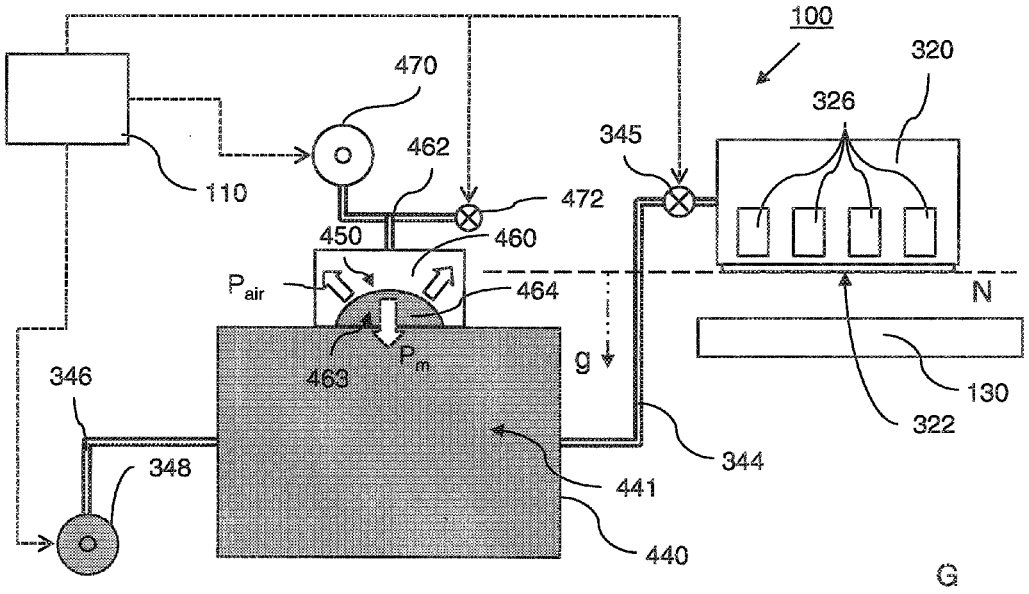

FIGS. 6A-6B show a printing system and a method for operating the printing system according to a fourth embodiment of the invention. In FIG. 6A the print head 320 comprises a nozzle plate 322, which may be similar to the nozzle plate 122 of the first embodiment or may be similar to the nozzle plate 222 of the second embodiment, wherein a non-wetting coating is provided on the nozzle plate.

The first fluid storing section 440 contains a first amount of the fluid 441. The first amount of the fluid 441 has an upper level 442, which is arranged at a certain height in the direction g below the level N of the plurality of nozzles 324. Due to the arrangement of the first amount of the fluid 441 below the level N, the first amount of the fluid 441 provides a negative fluid pressure $P_1$ on the meniscus of the fluid, which is present in the nozzles 324, based on the upper level 442 of the first amount of the fluid 441.

In the fourth embodiment the first fluid storing section 440 comprises a membrane 450. The membrane is arranged in a wall 452 of the first fluid storing section 440. An air pressure chamber 460 is arranged in connection to the wall 452 and enclosing the membrane 450. The air pressure chamber 460 is configured for deflecting the membrane 450. The air pressure in the air pressure chamber 460 is provided by the air pump 470, which is controlled by the control unit 110. The air tube 462 provides air communication from the air pump 470 to the air pressure chamber 460.

In FIG. 6A a standby position of the membrane 450 is shown. In the standby position the membrane 450 is not deflected and is arranged substantially parallel to the wall 452. In printing operation the membrane 450 is deflected in order to attain a pre-tension position of the membrane 450.

In FIG. 6B a pre-tension position of the membrane 450 is shown. The air pump 470 provides a negative air pressure $P_{air}$ in air pressure chamber 460 in order to deflect the membrane 450 into the air pressure chamber 460 to a certain extend. As a result a second fluid storing section 464 is formed between the membrane 450 and the position of the wall 452 of the first fluid storing section 440, the second fluid storing section 464 thereby containing a second amount of the fluid 463 in a pre-tension state. In fact the second fluid storing section 464 is automatically filled by fluid provided through the first fluid storing section 440.

The membrane 450 is a flexible and resilient element and provides in deflected form a membrane spring pressure $P_m$ against the second amount of the fluid 463, which membrane spring pressure $P_m$ is communicated by the second amount of fluid 463 to the meniscus of the fluid in the nozzles 324. The membrane 450 is retained stationary in the pre-tension position (i.e. in deflected form) by the negative pressure $P_{air}$ in the air pressure chamber 460. As such the membrane spring pressure $P_m$ is restrained in printing operation from acting on the first fluid storing section 440 (as indicated by dashed arrow $P_m$) and likewise on the nozzle 324.

The membrane spring pressure $P_m$ is easily adjusted by adjusting the negative air pressure $P_{air}$ in the air pressure chamber 460. The control unit 110 adjusts the negative air pressure $P_{air}$ based on predetermined information about the fluid (such as surface tension) and the print head (such as nozzle diameter) in order to suitably adapt the membrane spring pressure $P_m$ for overflowing the nozzle plate by a third amount of fluid in a power down situation.

In a power down situation the negative air pressure $P_{air}$ is released from the air pressure chamber 460 by opening an air valve 472. The air valve 472 is held close during printing operation by active control of the control unit 110. The air valve 472 automatically opens in a power down situation due to a spring element of the air valve 472 (i.e. a fail to open air valve). In the power down situation an ambient air pressure starts acting on the membrane 450 and on the second amount of the fluid 463. Accordingly the fluid pressure $P_u$, which is provided by the membrane spring pressure $P_m$, starts acting on the meniscus of the fluid in the nozzle 324 at the start of the power down situation.

As a result a film of fluid is formed on the nozzle plate around the nozzle 324 containing the third amount of fluid similar to the first embodiment described above and shown in FIG. 2C-2D or similar to the second embodiment described above and shown in FIG. 4B-4C, in case the nozzle plate 322 comprises a non-wetting coating, which encloses the nozzle 324.

In the fourth embodiment shown in FIG. 6A the membrane 450 is arranged in the wall 452 at the upper level 442 of the first fluid storing section 440. Alternatively the membrane 450 may be arranged in any other wall of the fluid storing section 440. It is not relevant how the membrane 450 is arranged with respect to the level N of the nozzles 324.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims is herewith disclosed.

Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A printing system for printing a fluid, the printing system comprising:

a print head for ejecting droplets of the fluid, the print head comprising a pressure chamber, the pressure chamber in printing operation containing the fluid, and a nozzle plate which comprises a nozzle, the pressure chamber being in fluid communication with the nozzle, the nozzle containing a meniscus of the fluid;

a first fluid storing section, in printing operation containing a first amount of the fluid, the first fluid storing section being in fluid communication to the fluid in the pressure chamber, the first amount of the fluid being arranged lower with respect to the nozzle, wherein lower is defined with respect to the gravity force acting downwards in a direction towards a ground level, thereby providing a negative fluid pressure on the meniscus of the fluid in the nozzle;

a second fluid storing section configured for storing a second amount of the fluid, the second fluid storing section in a power down situation being arranged in fluid communication to the pressure chamber; and a pre-tension mechanism configured for:

in printing operation, arranging the second amount of the fluid in a pre-tension state in the second fluid storing section, and retaining in printing operation the second amount of the fluid inside the second fluid storing section in the pre-tension state, thereby in printing operation restraining the positive fluid pressure from acting on the meniscus of the fluid in the nozzle, and in the power down situation, stop retaining the second amount of fluid inside the second fluid storing section, wherein said pre-tension state of the second amount of fluid provides a positive fluid pressure on the meniscus of the fluid in the nozzle in response to the power down situation, and the positive fluid pressure is selected such that a third amount of the fluid passes through the nozzle in response to said positive fluid pressure and forms a film on the nozzle plate, and wherein the pre-tension mechanism is controlled such that in the power-down situation, the positive fluid pressure of the pre-tension state is provided on the meniscus of the fluid in the nozzle for forming the film on the nozzle plate.

2. The printing system of claim 1, the printing system further comprises a control unit configured for selecting the positive fluid pressure based on a surface tension $\gamma$ of the fluid and the radius r of the nozzle in order that the positive fluid pressure on the meniscus of the fluid in the nozzle is at least larger than $2\gamma/r$ and controlling the pre-tension mechanism for adjusting the pre-tension state based on the selected positive fluid pressure.

3. The printing system of claim 1, wherein the printing system further comprises a releasing device configured for releasing the second amount of the fluid in the second fluid storing section in response to the power down situation, thereby providing the fluid pressure acting on the meniscus of the fluid in the nozzle and overflowing the nozzle plate by said third amount of the fluid.

4. The printing system of claim 1, wherein the nozzle plate comprises a non-wetting portion, which non-wetting portion encloses the nozzle.

5. The printing system of claim 2, wherein the second amount of the fluid in printing operation is arranged higher than the nozzle thereby providing a hydrostatic fluid pressure on the meniscus of the fluid in the nozzle, and wherein the pre-tension mechanism comprises an upper level maintaining device for in printing operation maintaining an upper level of the second amount of the fluid at a predetermined height above the meniscus of the fluid in the nozzle, wherein the predetermined height is adapted such that the hydrostatic fluid pressure on the meniscus of the fluid in the nozzle is at least larger than $2\gamma/r$.

6. The printing system of claim 5, wherein the printing system further comprises a sensor for detecting the upper level of the second amount of the fluid, the sensor sending a signal to the control unit based on the detected upper level.

7. The printing system of claim 5, wherein the pre-tension mechanism further comprises a fluid pump configured for in operation moving fluid to the second fluid storing section, thereby adjusting the upper level of the second amount of the fluid.

8. The printing system of claim 5, wherein the upper level maintaining device is an air pressure device, the air pressure device providing in printing operation a negative air pressure in the second fluid storing section above the upper level of the second amount of the fluid.

9. The printing system of claim 5, wherein the pre-tension mechanism includes a closed upper end of the second fluid storing section, which closed upper end is movably arranged in a height direction with respect to the nozzle, and wherein the upper level maintaining device is configured for maintaining the closed upper end of the second fluid storing section at the predetermined height above the meniscus of the fluid in the nozzle.

10. The printing system of claim 5, wherein the second fluid storing section comprises a tube portion for retaining the second amount of the fluid, wherein the tube portion has a mean diameter which is smaller than 10 mm, the mean diameter of the tube being preferably smaller than 5 mm.

11. The printing system of claim 1, wherein the first fluid storing section comprises a membrane, and wherein the pre-tension mechanism comprises a membrane deflecting device being configured for in printing operation deflecting the membrane, thereby forming said second fluid storing section for containing the second amount of the fluid, the deflected membrane inducing a membrane fluid pressure on the meniscus of the fluid in the nozzle, which is adapted for overflowing the nozzle plate, the pre-tension mechanism in printing operation restraining the membrane fluid pressure from acting on the meniscus of the fluid in the nozzle.

12. A method for operating a printing system, the printing system comprising a print head for ejecting droplets of a fluid, the print head comprising a pressure chamber arranged for containing the fluid and a nozzle plate which comprises a nozzle, the pressure chamber being in fluid communication to the nozzle;

a first fluid storing section for storing a first amount of the fluid, the first fluid storing section being in fluid communication to the fluid in the pressure chamber, the first amount of the fluid being arranged lower with respect to the nozzle, wherein lower is defined with respect to the gravity force acting downwards in a direction towards a ground level, in order to provide a negative fluid pressure in the nozzle; and a second fluid storing section for storing a second amount of the fluid, the second fluid storing section being arranged in fluid communication to the pressure chamber in a power down situation, wherein the method comprises the steps of:

a) providing the fluid in the pressure chamber of the print head, thereby forming a meniscus of the fluid in the nozzle;

b) providing a first amount of the fluid in the first fluid storing section;

c) arranging a second amount of the fluid in a pre-tension state in the second fluid storing section in printing operation by a pre-tension mechanism;

d) retaining in printing operation the second amount of the fluid inside the second fluid storing section, thereby in printing operation restraining the positive fluid pressure from acting on the meniscus of the fluid in the nozzle; and e) the pre-tension mechanism stopping retaining the second amount of fluid inside the second fluid storing section in a power down situation, thereby inducing a positive fluid pressure with respect to the meniscus of the fluid in the nozzle, wherein the positive fluid pressure is selected such that a third amount of the fluid passes through the nozzle in response to said positive fluid pressure in the power down situation and forms a film on the nozzle plate.

13. The method according to claim 12, wherein step c) comprises arranging an upper level of the second amount of the fluid at a predetermined height above the meniscus of the fluid in the nozzle, thereby inducing a hydrostatic fluid pressure on the meniscus of the fluid in the nozzle; and step d) comprises maintaining the upper level of the second amount of the fluid at the predetermined height, thereby restraining the hydrostatic fluid pressure from acting on the meniscus of the fluid in the nozzle, wherein the hydrostatic fluid pressure is at least larger than $2\gamma/r$, wherein $\gamma$ is the surface tension of the fluid and r is the radius of the nozzle.

14. The method according to claim 13, wherein step d) comprises providing a negative air pressure in the second fluid storing section above the upper level such that the upper level of the second amount of the fluid is maintained at the predetermined height.

15. The method according to claim 12, wherein the first fluid storing section comprises a membrane, and wherein step c) comprises deflecting the membrane, thereby forming said second fluid storing section containing said second amount of the fluid and wherein the positive fluid pressure comprises a membrane fluid pressure based on the deflected membrane; and wherein step d) comprises maintaining the membrane in the deflected state, thereby restraining the membrane fluid pressure from acting on the meniscus of the fluid in the nozzle.

16. The printing system of claim 9, wherein the second fluid storing section comprises a tube portion for retaining the second amount of the fluid, wherein the tube portion has a mean diameter which is smaller than 10 mm, the mean diameter of the tube being preferably smaller than 5 mm.

17. The printing system of claim 2, wherein the first fluid storing section comprises a membrane, and wherein the pre-tension mechanism comprises a membrane deflecting device being configured for in printing operation deflecting the membrane, thereby forming said second fluid storing section for containing the second amount of the fluid, the deflected membrane inducing a membrane fluid pressure on the meniscus of the fluid in the nozzle, which is adapted for overflowing the nozzle plate, the pre-tension mechanism in printing operation restraining the membrane fluid pressure from acting on the meniscus of the fluid in the nozzle.

18. A printing system for printing a fluid, the printing system comprising:

a print head for ejecting droplets of the fluid, the print head comprising a pressure chamber, which pressure chamber in printing operation contains the fluid, and a nozzle plate which comprises a nozzle, the pressure chamber being in fluid communication to the nozzle, the nozzle containing a meniscus of the fluid;

a first fluid storing section, in printing operation containing a first amount of the fluid, the first fluid storing section being in fluid communication to the fluid in the pressure chamber, the first amount of the fluid being arranged lower with respect to the nozzle, wherein lower is defined with respect to the gravity force acting downwards in a direction towards a ground level, thereby providing a negative fluid pressure on the meniscus of the fluid in the nozzle;

a second fluid storing section configured for storing a second amount of the fluid, the second fluid storing section in a power down situation being arranged in fluid communication to the pressure chamber; and a pre-tension mechanism configured for:

in printing operation, arranging the second amount of the fluid in a pre-tension state in the second fluid storing section, and retaining in printing operation the second amount of the fluid inside the second fluid storing section in the pre-tension state, thereby in printing operation restraining the positive fluid pressure from acting on the meniscus of the fluid in the nozzle, and in the power down situation, stop retaining the second amount of fluid inside the second fluid storing section, wherein said pre-tension state of the second amount of fluid provides a positive fluid pressure on the meniscus of the fluid in the nozzle in response to the power down situation, and the positive fluid pressure is selected such that a third amount of the fluid passes through the nozzle in response to said positive fluid pressure and forms a film on the nozzle plate, and wherein the pre-tension mechanism is controlled such that in the power-down situation, the positive fluid pressure of the pre-tension state is provided on the meniscus of the fluid in the nozzle for forming the film on the nozzle plate, wherein:

the printing system further comprises a control unit configured for selecting the positive fluid pressure based on a surface tension $\gamma$ of the fluid and the radius r of the nozzle in order that the positive fluid pressure on the meniscus of the fluid in the nozzle is at least larger than $2\gamma/r$ and controlling the pre-tension device for adjusting the pre-tension state based on the selected positive fluid pressure, the printing system further comprises a releasing device configured for releasing the second amount of the fluid in the second fluid storing section in response to the power down situation, thereby providing the fluid pressure acting on the meniscus of the fluid in the nozzle and overflowing the nozzle plate by said third amount of the fluid, the second amount of the fluid in printing operation is arranged higher than the nozzle thereby providing a hydrostatic fluid pressure on the meniscus of the fluid in the nozzle, and wherein the pre-tension mechanism comprises an upper level maintaining device for in printing operation maintaining an upper level of the second amount of the fluid at a predetermined height above the meniscus of the fluid in the nozzle, wherein the predetermined height is adapted such that the hydrostatic fluid pressure on the meniscus of the fluid in the nozzle is at least larger than $2\gamma/r$, the printing system further comprises a sensor for detecting the upper level of the second amount of the fluid, the sensor sending a signal to the control unit based on the detected upper level, the pre-tension mechanism further comprises a fluid pump configured for in operation moving fluid to the second fluid storing section, thereby adjusting the upper level of the second amount of the fluid, and the upper level maintaining device is an air pressure device, the air pressure device providing in printing operation a negative air pressure in the second fluid storing section above the upper level of the second amount of the fluid.

* * * * *